US005604327A

United States Patent [19]

Skoglund et al.

[11] Patent Number: 5,604,327

[45] Date of Patent: Feb. 18, 1997

[54] ORDNANCE

[75] Inventors: Örjan Skoglund, Kristinehamn; Bengt Berglund, Karlskoga; Peter Gardsiö ; Bertil Wall, both of Kristinehamn, all of Sweden

[73] Assignee: Bofors AB, Karlskoga, Sweden

[21] Appl. No.: 597,685

[22] Filed: Feb. 6, 1996

Related U.S. Application Data

[63] Continuation of Ser. No. 358,091, Dec. 16, 1994, abandoned.

[30] Foreign Application Priority Data

Dec. 17, 1993 [SE] Sweden ..... 9304188-7

[51] Int. Cl.[6] ..... F41A 9/14

[52] U.S. Cl. ..... 89/46; 89/45; 89/37.13; 89/40.04; 89/40.13

[58] Field of Search ..... 89/45, 46, 47, 89/33.05, 34, 37.13, 40.04, 40.13

[56] References Cited

U.S. PATENT DOCUMENTS

| | | | |
|---|---|---|---|
| 2,526,847 | 10/1950 | Brereton | 89/46 |
| 2,785,607 | 3/1957 | Henstrom et al. | 89/45 |
| 3,242,813 | 3/1966 | Carlsson | 89/46 |
| 4,145,953 | 3/1979 | Bergling et al. | 89/46 |
| 4,733,596 | 3/1988 | Crow, III et al. | 89/34 |
| 4,928,574 | 5/1990 | Golden | 89/34 |
| 4,945,813 | 8/1990 | Moscrip et al. | 89/33.1 |
| 4,991,489 | 2/1991 | Lindberg | 89/45 |

FOREIGN PATENT DOCUMENTS

| | | | |
|---|---|---|---|
| 2501425 | 7/1975 | Germany | 89/45 |
| 3294793 | 12/1991 | Japan | 89/47 |
| WO89/03014 | 4/1989 | WIPO | 89/34 |

OTHER PUBLICATIONS

Bofors Weapon Systems, Bofors Field Artillery, 1985, pp. 1–23.

K. C. Pan, Application of Robots in Ammo Handling/Loading, Army Research, Development, and Acquisition Magazine, Sep. 10, 1983, pp. 15–17.

*Primary Examiner*—Stephen M. Johnson

*Attorney, Agent, or Firm*—Pollock, Vande Sande & Priddy

[57] ABSTRACT

The present invention relates to an ammunition handling system primarily for self-propelled artillery guns (1). According to the invention, the gun (1) in question is provided with carrier arms (19, 20) which are pivotally journalled in the chassis of the gun and which carry special ammunition magazines (21,22) or cassettes in which a primary requirement of propellant charges (18) and shells (14) is stored. In such instance, the design of the carrier arms (19 and 20) and magazine (21, 22) is such that the magazine may be pivoted by simple manoeuvres forwards from a transport position where they are folded-in, in a direction towards the centre line of the gun, to a second position closely adjacent the loading breech of the gun or the replenishment position for auxiliary systems (13, 17) utilized on loading of the gun. The present invention also encompasses specific designs of the relevant magazines and a piece of ordnance designed in accordance with the inventive concept has herein disclosed.

11 Claims, 3 Drawing Sheets

ORDNANCE

This application is a Continuation of U.S. patent application Ser. No. 08/358,091, filed Dec. 16, 1994 now abandoned.

FIELD OF THE INVENTION

The present invention relates to an ammunition handling system for ordnance, principally for self-propelled guns. The invention is primarily intended to be employed in cases of retrofitting or upgrading hand-loaded older pieces of ordnance, and such pieces of ordnance that are provided with partly mechanized loading systems. However, the present invention may also be utilized on newly produced ordnance when, for various reasons, the intention is not to move directly to self-propelled guns with fully automatic self-loading systems and the high costs that are linked to such systems.

A first advantage inherent in the system according to the present invention is that it makes immediately available a sufficient quantity of ammunition for a first combat effort, preparedness ammunition, for the gun crew as soon as the gun has reached its firing position, without the involvement of other vehicles. Another advantage inherent in the system according to the present invention is that as soon as a piece of ordnance fitted therewith can take up a firing position, the piece of ordnance can be ready to leave an earlier firing position in favor of a new one. Pieces of ordnance designed in accordance with the present invention are, as a result, extremely well-suited for modern artillery and its demands on rapid and constant alterations of firing positions in order to avoid artillery combat from the enemy.

BACKGROUND OF THE INVENTION

In order to be certain of achieving an effect on the target, it has previously been necessary to group together a plurality of pieces of ordnance in batteries and utilize them simultaneously against the same target. With the advance of new so-called intelligent and possibly final phase controlled ammunition, the possibilities of effect on the target using individual or a few rounds have, however, increased to such an extent that, in future, it must be considered as substantially more attractive than before to allow pieces of ordnance to fight individually against their own targets. This fundamentally novel behavioral approach in the gunnery art is also greatly facilitated by the present invention.

History abounds in a large number of different types of ordnance pieces which have been produced, irrespective of whether they might be towed by vehicles or be self-propelled have been dependent upon the supply of shells and propellant charges via separate ammunition limbers or vehicles. Whether such pieces of ordnance were entirely loaded by hand or provided with some form of auxiliary loading system is of no major consequence in this context. Given that, moreover, the gun crew as a rule is conveyed in its own vehicle or vehicles, it has generally been necessary that several vehicles converge at the intended gun site before the actual preparations for opening of fire can begin. This naturally entails that it has always taken a certain time to discharge the first round, at the same time such accumulation of vehicles naturally increasing the risk of discovery.

In addition to the more conventional artillery of the above-intimated type, self-propelled guns have also been found primarily within armored units, these guns often being mounted on the MBT chassis which, in addition to often having been provided with its own armored carapace, also carries a complete gun crew and its own first-hand ammunition requirements. Moreover, these armored guns were also more often than not self-loading. However, such armored guns are becoming so expensive that, in all likelihood, they will never entirely supersede more conventional artillery.

SUMMARY OF THE INVENTION

The present invention proposes an extremely cost-effective solution for modern artillery in which each piece of ordnance when required shah be capable of acting as a separate unit which, practically immediately upon reaching a contemplated gun site, will be ready for action and just as quickly be made ready for a shift of firing position. Thus, the present invention is an ammunition handling system for pieces of ordnance primarily adapted for self-propelled guns intended for conventional manual loading or provided with auxiliary loading systems, for example of the type in which the shells are fed via a mechanically driven loading platform to a shell cradle to which the propellant charges are also fed mechanically or manually, whereafter loading proper takes place. This type of semi-mechanized gun has become extremely common since it is highly cost-effective and is capable of discharging a relatively large tonnage of rounds towards the target within a very limited amount of time.

A characterizing feature of the ammunition handling system according to the invention is that the primary requirement of ammunition for the gun, the preparedness ammunition, is stored in cassettes or magazines which are suspended in the gun carriage or its chassis on carrier arms which are pivotal in relation thereto and which make it possible to swing out these cassettes or magazines from a first transport position where they do not impede the terrain mobility index of the gun, to a second loading position where they lie a convenient distance from and at a suitable height in relation to the breech opening of the gun, or alternatively the replenishment position for an auxiliary system utilized for loading the gun.

In heavy and medium artillery, the shell and it propellant charges are generally loaded separately, and then the arrangement according to the invention is suitably designed with carrier arm pairs symmetrically disposed on either side of the gun carriage or its chassis, of which the carrier arm or arms disposed on one side of the gun carry cassettes or magazines intended for shells, while those on the opposite side are intended for propellant charges. This is because the shells and their propellant charges are of totally different weights and therefore require completely different auxiliary systems. The present invention further embodies the feature that the movement pattern of the different carrier arms is adapted so that they can follow the lateral aiming of the gun while the cassettes or magazines may be rotated and possibly also adjusted in the vertical direction so that they are always located in a position most appropriate for the loading operation.

If the gun is to be loaded with cartridge ammunition, it is naturally possible to use the invention concept as herein disclosed such that only one cartridge magazine is provided or alternatively several such symmetrically disposed magazines on either side of the chassis of the gun. The different magazines may then contain different types of shells.

Since, as a rule, different preparations are carried out for shells and propellant charges, and since these are of totally different weights, it might be appropriate to design the cassettes and magazines intended for propellant charges and shells, respectively, in different ways. In one preferred embodiment according to the present invention, it is therefore proposed that the shell cassette or magazine be designed basically as a chest-of-drawers with wholly retractable boxes where the shells lie beside one another and then preferably parallel with one another in the direction of retraction of each respective drawer or box. This is particularly suitable when the gun is provided with special lifting devices with which one or more shells at a time are transferred to a loading platform from which they in turn are supplied to a loading cradle in order to be loaded into the gun either alone or together with the propellant charge. Lying on the loading platform or already in the retracted box, the fuses having previously been assembled and programmed. By changing boxes it is, moreover, very simple to switch rapidly between different types of shells.

As far as the propellant charges are concerned, the cassettes or magazines are designed with compartments for each charge and these compartments are suitably made accessible from opposite sides so that they can in turn be picked from one side while being accessible from the other side for adaptation to the ranges relevant in each particular case. This procedure is already in fact carried out in that part- or sub-charges are added or removed.

The inventors succeeded in providing a particularly advantageous combination according to the present invention by evolving an artillery system comprising a gun mounted at the rear end of a centrally articulated, multi-wheel driven dumper of substantially conventional, wholly civilian type, the barrel of the gun having been given a major direction with the muzzle aimed forwards, that is with the normal driving direction of the dumper. With this arrangement, the loading breech of the gun lies thus flush with the rear end of the dumper and an open-out ground support is also provided at the latter, this support being intended to take up those components of the recoil forces generated on firing which cannot be eliminated in the recoil and recuperation damper of the gun. The gun in question may also be laterally aimed within those angles which are covered by the ground support when this is in its lowered, operative position.

The carrier arms characteristic of the present invention are further journalled in the chassis of the dumper just ahead of the journalling of the gun therein and the cassettes or magazines suspended at the outer ends of the carrier arms can, on displacement of the dumper gun, be collapsed in towards the chassis of the dumper ahead of its rear wheel bogie. The outward and inward folding of the carrier arms takes place either by using manual force or some form of mechanical device and they can be braked against overly violent movement and be locked in the desired position.

In order to make a gun of this type ready for action, it is only necessary to drive up to the intended gun site, lower the ground support device and flip out the carrier arms, give the cassettes or magazines the suitable angular positioning and open them, make the charges ready for the intended range by additional charges or the removal of sub-charges, arm the shells with fuses and commence loading of the gun, in order, shortly thereafter, to be able to open fire. For change of firing position, it is merely required that the cassettes or magazines be closed, the carrier arms folded in and locked in the folded-in position, while the ground support is raised (preferably hydraulically), while the barrel of the gun is lashed in place and the gun crew climb into their places in the personnel section of the dumper. This latter can be provided with an armored superstructure to protect against flying splinters.

BRIEF DESCRIPTION OF THE ACCOMPANYING DRAWINGS

The present invention will now be described in greater detail hereinbelow, with particular reference to the accompanying Drawings. In the accompanying Drawings.

DETAILED DESCRIPTION OF PREFERRED EMBODIMENT

Figure 3:
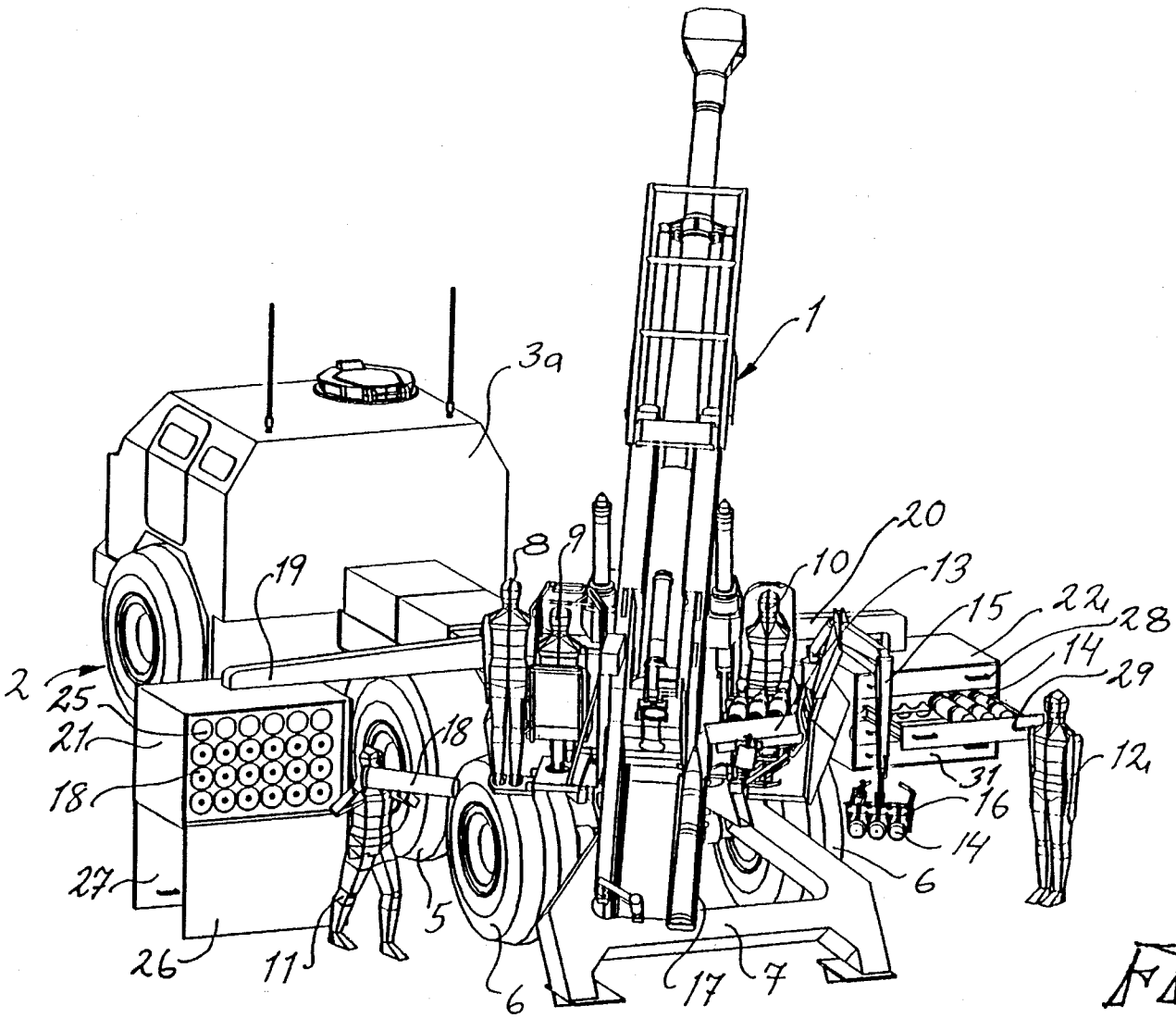
FIG. 3 shows a gun of corresponding type in action, but in this case provided with an armor-shielded gun crew space.

Disregarding the gun crew space which, in FIG. 3, is of the armor-shielded type, the different parts included in the guns are identical in all essentials, for which reason they have also been given the same reference numerals. As chassis for the gun 1, use is made of a conventional multi-wheel driven, centrally articulated dumper 2 whose forward region 3 (provided with engine and crew spaces) has, in the embodiment shown in FIG. 3, been provided with armored protection 3*a* which protects against splinters. The rear region 4 of the dumper 2 acts partly as a platform mount for the gun 1 and partly for suspension of the wheel bogie of the dumper with the wheel axles 5 and 6 and associated wheels. In addition, there is disposed at the free outer end of the rear region 4 of the dumper, a hydraulically lowerable ground support 7. (All figures show this in the lowered position, but as soon as the gun is to be moved, it is raised away from the ground). The purpose of the ground support is to take up the recoil forces from the firing of the gun which are not absorbed in the recoil and recuperation system proper of the gun 1. On the gun, there is further room for a gun commander 8, a gun layer 9 and a first loader 10, as well as, beside the gun and down at ground level, a second loader 11 and a third loader 12. These key men included in the gun crew, who are the only members of the crew needed for firing the twenty-four rounds making up the preparedness ammunition of the gun alternative shown on the Drawings, are all depicted in FIG. 3. The figures further show a number of auxiliary loading systems which have already been utilized on other guns, namely a loading platform 13 operated by the first loader 10 and supplied by the third loader 12 with three shells 14 at a time, with the assistance of a loading hoist 15 having specially designed gripping devices 16. From the loading platform 13, the shells are fed via a loading chute to a loading bridge 17 to which the second loader 11 also manually supplies propellant charges 18, since these are relatively light in weight. From the loading bridge, the shell 14 and the propellant charge 18 are rammed home in the gun as a unit.

Figure 1:
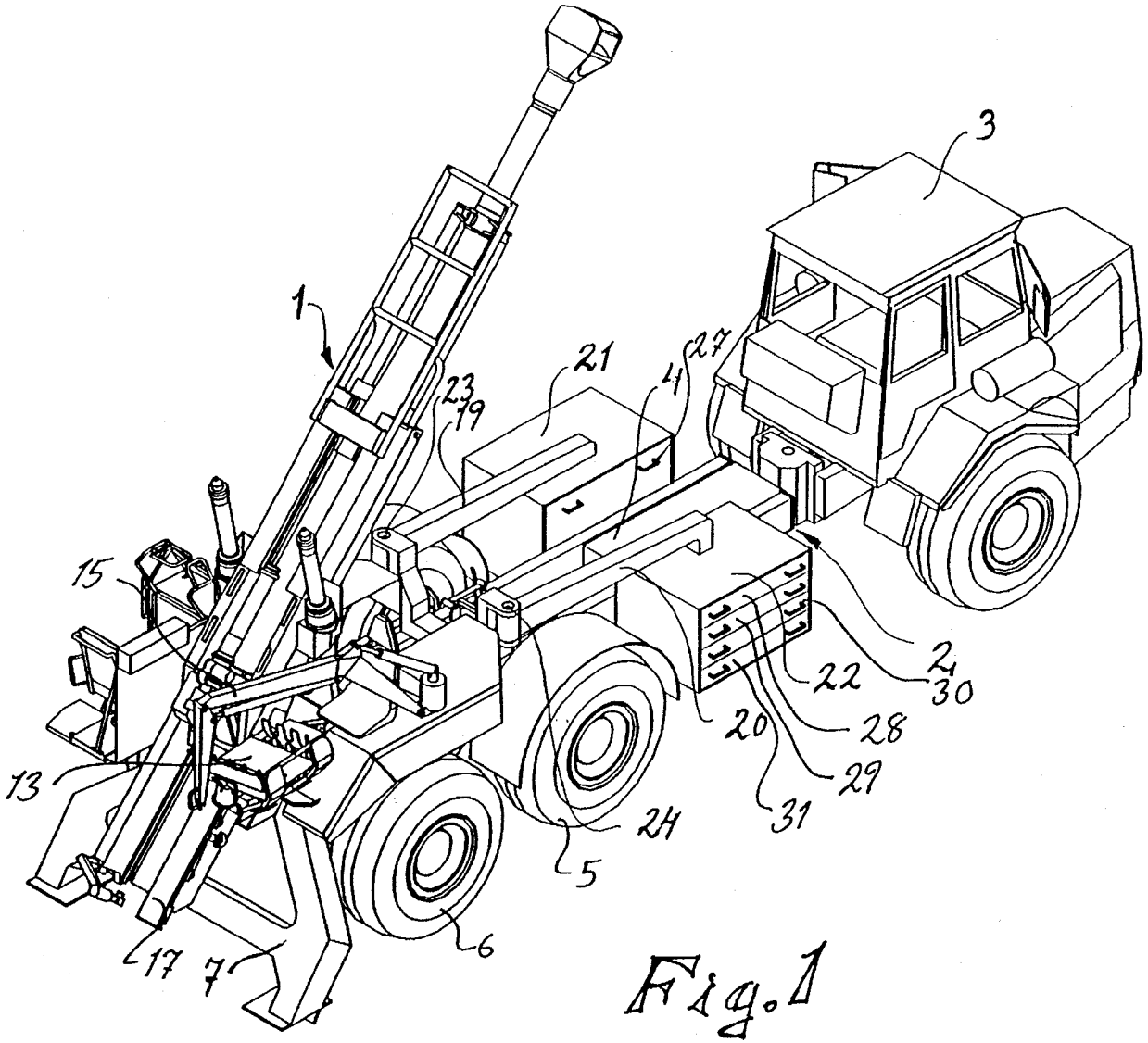
FIG. 1 is an oblique projection of a self-propelled gun designed according to the present invention and grouped in position but not yet made ready for action.
Figure 2:
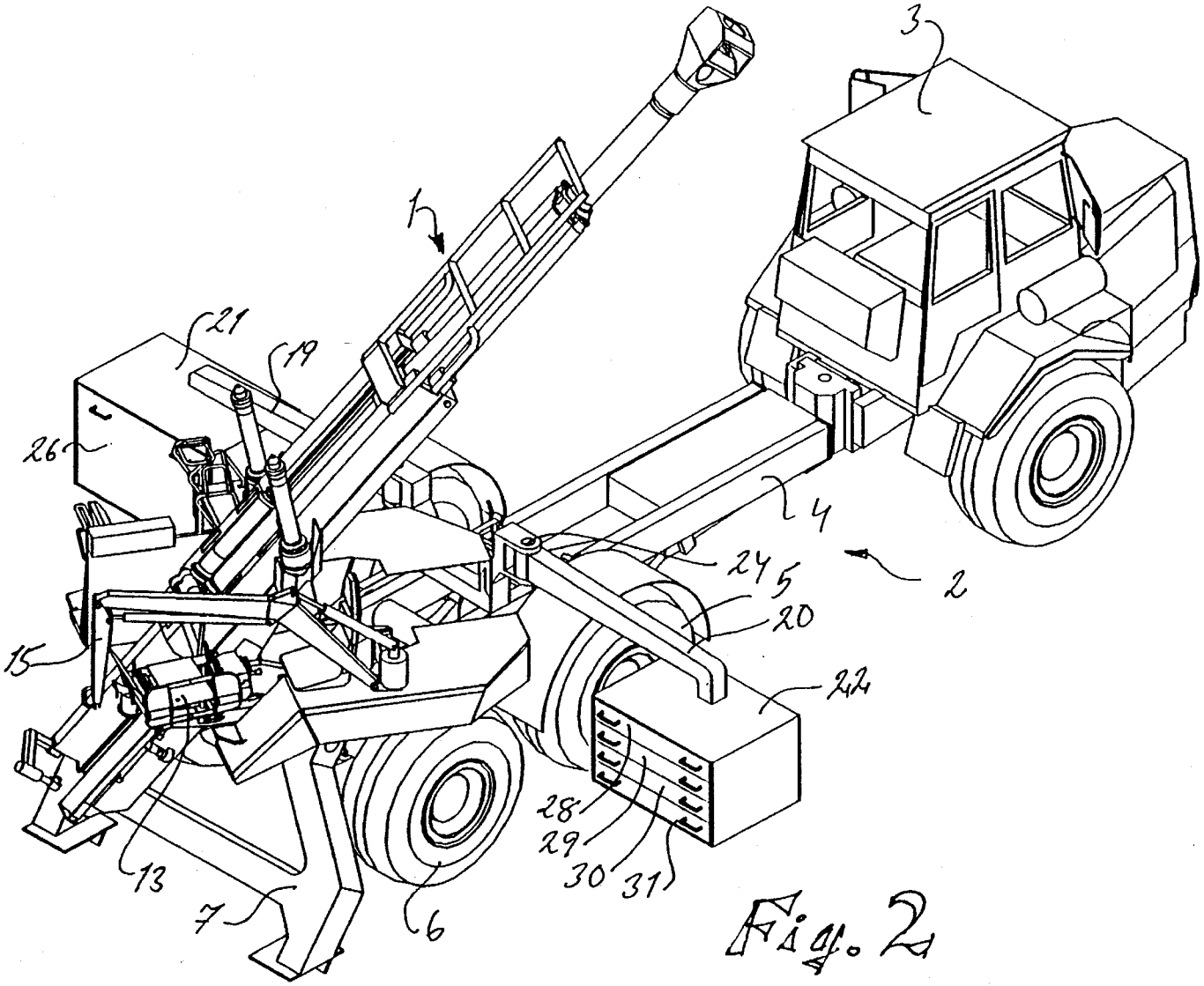
FIG. 2 shows the same gun as in FIG. 1 in the ready position but before the gun crew have taken their places and commenced loading the gun.

In the ammunition handling system of the present invention, there now are included carrier arms 19 and 20, respectively, which are disposed on either side of the rear region of the dumper and are rotatably journalled about vertical shafts 23 and 24 flush with the forward back axle of the dumper, the arms in turn carrying the cassettes or magazines 21, 22, respectively, of which the first is intended for propellant charges while the second is intended for shells. The carrier arms 19 and 20, respectively, can thus be folded or pivoted out from the inwardly folded or closed position illustrated in FIG. 1, i.e. the transport position which is assumed as soon as the dumper is to move, to the outwardly opened loading position illustrated in FIGS. 2 and 3 where the cassettes or magazines suspended from the outer ends of the carrier arms are located at a distance and vertical position from the auxiliary loading systems 13 and 17, respectively, convenient for the loading operation in question. In addition, the carrier arms are provided with locking means (not shown) by means of which it is possible to lock them in the outward and inward positions, respectively.

The gun 1 has a lateral field of aim within that angle which is covered by the ground support 7 and the position of the carrier arms which, on any occasion, may be corrected in accordance with the lateral aiming position of the gun.

Finally, the present invention also encompasses the design of the cassettes or magazines 21 and 22, respectively. Of these, the cassette 21 is intended for propellant charges and it is, therefore, provided with twenty-four propellant charge compartments 25 each intended for one charge. These compartments are accessible from both directions via openable hatches or doors 26, 27, provided on either side of the cassette and of which the door 26 facing towards the loading breech of the gun may be utilized by the second loader 10 for taking out propellant charges 18, while the opposite door 27 is used when the intention is to adapt the propellant charges to a specific range by the addition or removal of sub-charges. The second cassette or magazine 22 is thus intended for shells 14 and, according to the invention, this is designed as a chest-of-drawers with four pull-out boxes 28–31 in which the shells 14 lie six-by-six beside one another ready to be lifted out three at a time using the lifting (gripping) device 16. By providing different types of shells in different boxes, it is possible to carry out very rapid changes of ammunition.

The present invention should not be considered as restricted to that described above and shown on the Drawings, many modifications being conceivable without departing from the spirit and scope of the appended claims.

What is claimed is:

1. An ammunition handling system for an ordnance gun of a self-propelled type with at least partly manual loading, comprising:

storing devices for storing a first requirement of ammunition; and carrier arms rotatably mounted at one end on opposite sides of one of a gun carriage and its chassis and at the other end supporting said ammunition storing devices;

said carrier arms being rotatably journalled between a first inwardly folded transport position in which said carrier arms and said storing devices are substantially aligned with longitudinal direction of the ordnance gun and do not impede mobility index of the ordnance gun chassis and a second unfolded loading position suitable for ammunition loading operations wherein said carrier arms extend outwardly with respect to said longitudinal direction.

2. An ammunition handling system according to claim 1 wherein in said second loading position said storing devices lie adjacent to a loading breech of the gun.

3. An ammunition handling system according to claim 1 wherein in said second loading position said storing devices are located at a replenishment position adjacent loading devices.

4. An ammunition handling system according to claim 1 wherein said carrier arms are rotatably journalled between said first and second position about vertical shafts, and wherein said storing devices comprise cassettes or magazines designed for storing shells and propellant charges.

5. Art ammunition handling system according to claim 4 wherein said carrier arms are symmetrically disposed, at least one on either side of one of the gun carriage and its chassis and wherein one said carrier arm is designed to carry said cassettes or magazines for said shells, and said carrier arm on the opposite side is designed to carry said cassettes or magazines for storing said propellant charges.

6. An ammunition handling system according to claim 5 wherein a movement pattern of said carrier arms is adapted so that they can follow the lateral aiming of the gun and said cassettes and magazines are rotatable about suspension points on said carrier arms, in each lateral aiming position of the gun, to provide the most advantageous position in relation to a gun breech opening.

7. An ammunition handling system according to claim 4 wherein a movement pattern of said carrier arms is adapted so that they can follow the lateral aiming of the gun and said cassettes or magazines are rotatable about suspension points on said carrier arms, in each lateral aiming position of the gun, to provide the most advantageous position in relation to a gun breech opening.

8. An ammunition handling system according to claim 4 wherein said cassettes or magazines in said second position, are located at a convenient height above ground level adjustable in a vertical direction with respect to said first transport position.

9. An ammunition handling system according to claim 4 wherein said magazines or cassettes for propellant charges are, in said second loading position, openable both along one side which faces toward a loading breech of the gun or a loading platform and another side which is opposite to said one side.

10. An ammunition handling system according to claim 4 wherein said cassettes or magazines for shells are designed as chest-of-drawers with pull-out boxes in which the shells are positioned beside one another so that, with each respective box in a withdrawn position, said shells can be grasped directly by a shell hoist associated with the gun, and change of ammunition may be effected by change of the box from which said shells are taken.

11. In an artillery unit comprising an artillery gun journalled at a rear end of a multi-wheel driven, centrally articulated dumper, a barrel of said gun having its major direction coinciding with a corresponding major direction of the dumper and with a direction of fire in a normal direction of travel, and whose barrel, once a ground support in said direction of travel of the dumper has been lowered, can be laterally aimed within an angular range which is covered by the ground support, an ammunition handling system including carrier arms for supporting cassettes or magazines for storing ammunition pieces, said carrier arms being journalled in a chassis of the dumper about substantially vertical shafts provided ahead of a journalling placement of the gun in the dumper, as seen in the direction of travel of the dumper, between a first transport position and a second loading outwardly extending position and wherein said cassettes or magazines in said first transport position of said carrier arms are folded in between forward and rear wheel bases of the dumper in order to reduce the width of the artillery unit so as to substantially correspond to the wheel width.

* * * * *